US008887834B2

(12) United States Patent
Millet

(10) Patent No.: US 8,887,834 B2
(45) Date of Patent: Nov. 18, 2014

(54) DRILLING TOOL STEERING DEVICE

(76) Inventor: Francois Millet, Antony (FR)

( * ) Notice: Subject to any disclaimer, the term of this patent is extended or adjusted under 35 U.S.C. 154(b) by 610 days.

(21) Appl. No.: 12/294,375

(22) PCT Filed: Mar. 26, 2007

(86) PCT No.: PCT/FR2007/000515
§ 371 (c)(1),
(2), (4) Date: Sep. 26, 2008

(87) PCT Pub. No.: WO2007/110502
PCT Pub. Date: Oct. 4, 2007

(65) Prior Publication Data

US 2009/0166089 A1 Jul. 2, 2009

(30) Foreign Application Priority Data

Mar. 27, 2006 (FR) ..... 06 02621

(51) Int. Cl.
*E21B 7/04* (2006.01)
*E21B 17/04* (2006.01)
*E21B 7/06* (2006.01)

(52) U.S. Cl.
CPC ..... *E21B 7/067* (2013.01); *E21B 17/04* (2013.01)
USPC ..... 175/61; 464/20

(58) Field of Classification Search
USPC ..... 175/61, 74, 45; 166/242.6; 277/591, 277/600; 464/18, 19, 20, 182
See application file for complete search history.

(56) References Cited

U.S. PATENT DOCUMENTS

| | | | | |
|---|---|---|---|---|
| 1,850,403 | A * | 3/1932 | Lee | 175/74 |
| 3,326,008 | A | 6/1967 | Baran et al. | |
| 4,011,918 | A * | 3/1977 | Jurgens | 175/325.2 |
| 4,858,705 | A | 8/1989 | Thiery | |
| 5,305,838 | A * | 4/1994 | Pauc | 175/73 |
| 5,839,508 | A * | 11/1998 | Tubel et al. | 166/65.1 |
| 5,875,859 | A * | 3/1999 | Ikeda et al. | 175/73 |
| 5,931,239 | A | 8/1999 | Schuh | |
| 5,957,222 | A * | 9/1999 | Webb et al. | 175/45 |
| 6,092,610 | A | 7/2000 | Kosmala et al. | |
| 6,629,571 | B1 * | 10/2003 | Downie | 175/61 |
| 6,640,909 | B2 * | 11/2003 | Vandenberg et al. | 175/73 |
| 6,808,027 | B2 | 10/2004 | McLoughlin et al. | |
| 7,188,685 | B2 | 3/2007 | Downton et al. | |
| 2002/0007969 | A1 * | 1/2002 | Head et al. | 175/61 |
| 2005/0150692 | A1 * | 7/2005 | Ballantyne et al. | 175/61 |
| 2005/0236187 | A1 * | 10/2005 | Chen et al. | 175/61 |
| 2006/0048585 | A1 * | 3/2006 | Meissner | 73/862.326 |
| 2007/0107937 | A1 * | 5/2007 | Sugiura | 175/45 |
| 2011/0240368 | A1 | 10/2011 | Allen et al. | |

FOREIGN PATENT DOCUMENTS

WO 2006/085105 A1 8/2006

* cited by examiner

*Primary Examiner* — Shane Bomar
*Assistant Examiner* — Kipp Wallace
(74) *Attorney, Agent, or Firm* — Larson & Anderson, LLC

(57) ABSTRACT

A drilling tool steering device includes, consecutively from upstream to downstream, a main body (1) and a steerable housing (2); a deflection system (7); and a flexible transmission shaft (3). The transmission shaft crosses the main body, the steerable housing, and the deflection system longitudinally, is bendable or flexible, and is connected to the main body (1) and to the steerable housing (2) by at least three connections forming bearings (4, 5, 6). Steering is carried out by the deflection system (7) acting by an essentially radial relative displacement of the main body (1) in relation to the steerable housing (2) in proximity of their interface.

20 Claims, 4 Drawing Sheets

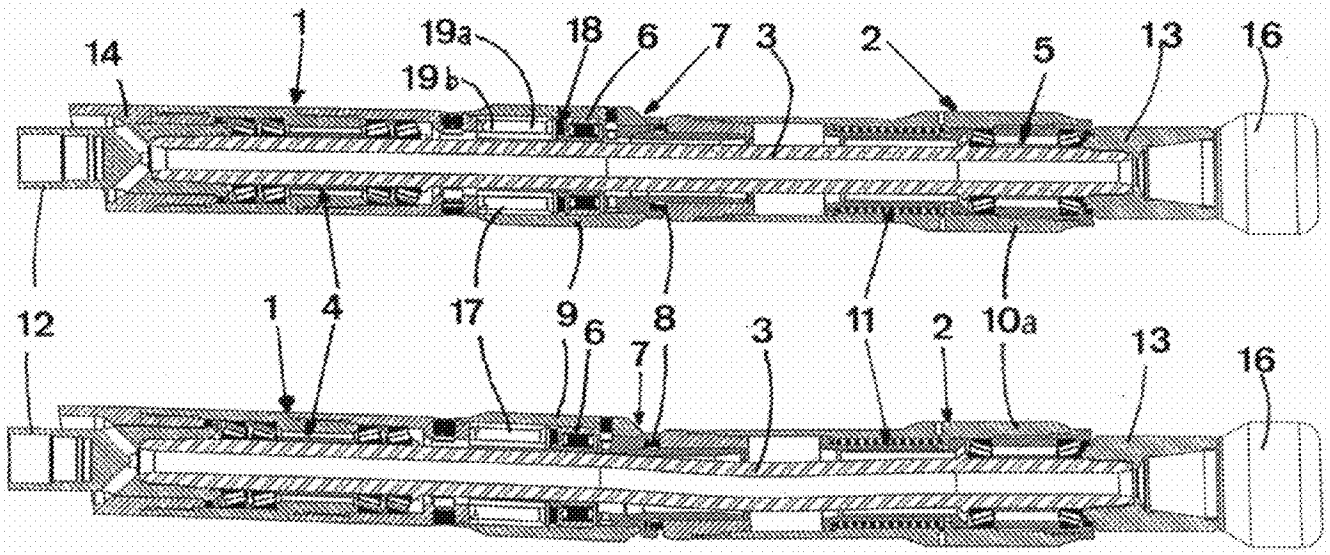
Fig. 7
Fig. 8
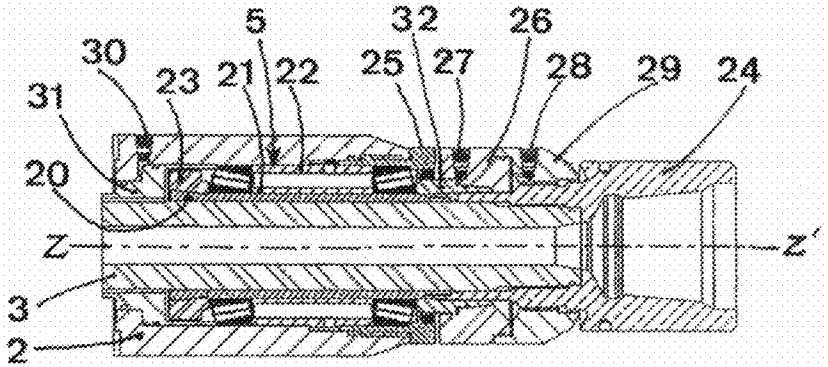
Fig. 9

DRILLING TOOL STEERING DEVICE

FIELD OF THE INVENTION

The present invention concerns the field of drilling. It concerns, in particular, drilling that necessitates trajectory control, notably in the fields of the petroleum and gas industry, civil engineering, geothermics and, in general, in all fields of trenchless underground operations.

In some of these fields, the drilling systems employed can be entirely mechanical or else include electronic equipment. These systems are roughly defined as follows:

- Static device: steerable connection, also called adjustable bent housing, adjusted on the surface to equip a turbine type downhole power section, PDM ("Positive Displacement Motor") or electric motor;
- Pseudodynamic device: steerable connection activated autonomously or from the surface, solely for the non-rotative sliding phases of the boring rods, designated by the English-language term "sliding," to equip a downhole power section of turbine type, or else stabilizing type of activated variable diameter, or other types;
- Dynamic device: system driven in real time from the surface or autonomously for creating rotary steerable drilling systems known to the expert as "Rotary Steerable System," abbreviated as RSS.

TECHNOLOGICAL BACKGROUND

With the methods most commonly used for making a static steerable connection placed at the end of a drill string, the length of the bent housing cannot be reduced without compromising the life of the thrust bearing used as support for the drilling tool. A transmission of weight on the tool is effected, described as WOB ("weight on bit"). It follows that wide connection angles are necessary to be able to obtain the deviations or curvatures usually called "Build-Up Rate" (BUR), which are sought in the applications concerned.

International application WO 90/07625 and U.S. Pat. Nos. 6,244,361, 6,640,909, 6,808,027 and 6,847,304 describe architectures of trajectory control devices of boring rods comprising a flexible shaft, employing a method called "static bit force (rotary traversing shaft)/Point the bit."

International application WO 90/07625 and U.S. Pat. Nos. 3,677,354, 5,305,838, 5,307,885, 5,353,884, 5,875,859, 6,808,027 and 6,847,304 describe, furthermore, so-called "internal" coupling means for forcing the steering of a transmission shaft used in such an application.

EP Patent 0,744,526 and U.S. Pat. No. 4,947,944 describe so-called "external" coupling means for a set of components of drill string and drilling tools.

International application WO 03/102353 certainly describes a drilling device containing a component for enabling and controlling the deviation of the shaft and drill bit. However, the device described in this document must contain two concentric tubular elements, respectively outer and inner, which can take a position in which they are uncoupled from one another, in order to make possible the rotation of the inner tubular element, while rotation of the outer tubular element is prevented.

The publication of US Patent Application No. 2005/0173155 describes an assembly of drilling means in which a locking means is provided to transmit to the shaft a torsional moment generated by the case or housing disengageably.

According to that state of the art, means were not available for steering drilling tools in all the required configurations.

Therefore, no universal steerable connection exists at present, in the sense understood in the conditions referred to above.

Now, it appeared useful to have such means available, advantageously with the ability to place them on the existing equipment, and it also appeared desirable for the manufacture and maintenance of those new means sought to be simple to carry out at a reasonable cost, in order to reduce the cost per meter drilled, while improving the precision of drilling and offering greater trajectory flexibility and the longitudinal compactness desired, in order to bring the measurements of the drilling tool/bit as close together as possible.

The invention makes it possible to introduce solutions for these expectations and to provide devices and operating means that can respond to these objectives as well as others, which will emerge in light of the following description, accompanying drawings and attached claims.

The present invention is, therefore, intended to create a device for steering a drilling tool (bit, PDC, drill, etc.), said device being usable in different variations adaptable to needs and, furthermore, easy to operate everywhere. In addition, its maintenance is easy and the lifetime of its most stressed parts is also improved, considering that the dissymmetry between upstream and downstream of the device is taken into account, namely, between the low end of the main drill string or BHA (Bottom Hole Assembly) and the drilling tool/bit, respectively.

SUMMARY OF THE INVENTION

One objective of the invention is to propose a steering device architecture, also called "steerable connection" or "adjustable bent housing connection," making it possible to overcome the limitations indicated above. Such a device has a reduced length and, consequently, offers a high BUR in spite of a narrow tilt angle (or steering angle), is also reliable and economical to manufacture and makes easy mounting and maintenance possible.

The device according to the present invention contains, in order to make it possible to control steering of the drilling tool/bit with which it is integrated, essentially a main body and a steerable housing, consecutively disposed from upstream to downstream and joined respectively by at least one connection advantageously of pivot, sliding pivot, ball joint or annular linear connection type forming a first bearing, and at least one pivot connection forming a second bearing, to a bendable or flexible transmission shaft which crosses them longitudinally, while an appropriate connection forming a third bearing between said transmission shaft and the main body is arranged in proximity to the end of said main body situated in the direction of the steerable case, and while steering is carried out thanks to means of essentially radial displacement of the main body in relation to the steerable housing in proximity to their interface, described below as "deflection system,"

the said main body being optionally equipped on its periphery with bearing pads of diameter less than or equal to the diameter of the drilling tool/bit, and the said steerable housing being optionally equipped on its periphery with bearing pads of diameter less than or equal to the diameter of the drilling tool/bit toward its end situated in the direction of the drilling tool/bit, and with fixed or expandable pads or clamps toward its end situated in the direction of the main body.

The function of said bearing pads is to bear on the wall of the well drilled for an optimal deviation of the drilling tool/bit and to slow down rotation on the axis of the well and possibly to stop or block the rotating device in cooperation with the walls of the well drilled in the case of clamps.

In the present context, the "downstream" direction standardly designates the direction of the drilling tool/bit, while the "upstream" direction designates the upper end of the boring rods.

Thus, the device according to the invention contains, consecutively from upstream to downstream, a main body and a steerable housing in functional relationship with the latter, a traversing shaft, as well as at least three bearings and preferably three bearings as defined above, and advantageously bearing pads and/or clamps as described above, the deflection exerted by means of an appropriate deflection system leading to the desired curvature of the bendable or flexible shaft, that is, in practice, to the tilt angle desired between the longitudinal axes of the main body and the steerable case.

In the device according to the invention, the shaft is markedly stressed in proximity to the said bearings, and it is then preferable for the set of bearings and other components cooperating with the shaft to be hooped.

With such a device, the shaft is bent by essentially radial displacement of the upper end of the steerable housing in relation to the lower end of the main body under the action of a deflection system.

In practice, such a deflection system is of known type, or else its design is within reach of the expert.

Said deflection is achieved, in practice, by essentially radial displacement of the upper end of the steerable housing in relation to the longitudinal axis of the main body, by means of a deflection system, bearing either on the transmission shaft or main body (so-called "internal" coupling) or on the wall of the well drilled (so-called "external" coupling).

Coupling can be only internal in the static version.

The originality of such a device resides essentially in the use of controlled bending of the transmission shaft in order to link the body of the device. Such method of operation of the device makes possible its compatibility with the existing steering devices, whether internal or external.

As for the deflection device integrated in the steering device according to the invention, it can be used, in the case of a static steering device, in the illustrative and nonrestrictive preferred embodiments by means of two radially eccentric rings, a ball joint and a sliding pivot connection; deflection is then obtained by differential rotation of the two rings.

BRIEF DESCRIPTION OF THE DRAWINGS

The invention will be better understood and other objectives, advantages and characteristics of same will more clearly appear in light of the detailed description below of preferred embodiments, given purely by way of illustration and not at all restrictive, while plates of drawings are attached to said description in which:

FIG. 7 is a more detailed representation in longitudinal section of a device according to the invention in its static version and in its straight drilling position;

FIG. 8 is a more detailed representation in longitudinal section of a device according to FIG. 7 in its curved drilling position;

FIG. 9 is a more detailed representation in partial schematic longitudinal section of a bearing assembly with hooped connection in a device according to the invention.

DETAILED DESCRIPTION OF THE INVENTION

Figure 1:
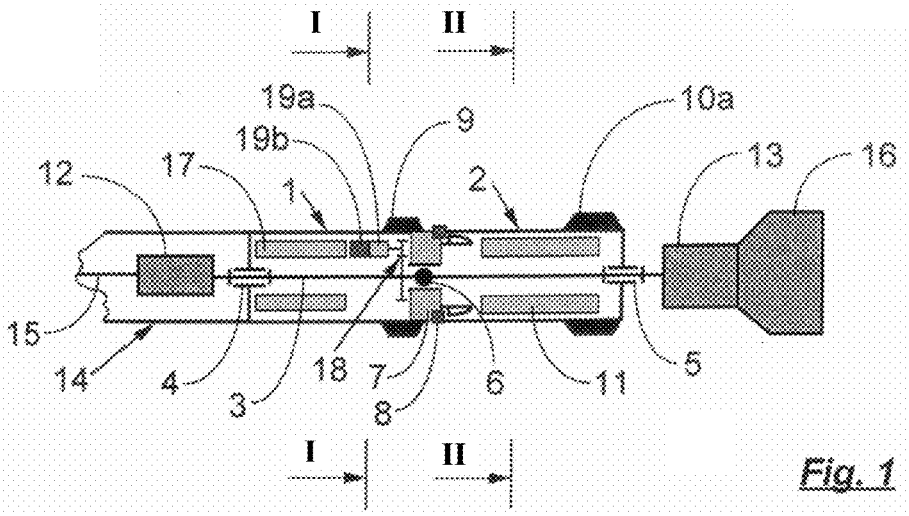
FIG. 1 represents in partial longitudinal schematic section, in its straight drilling position and in its embodiment described as static or pseudodynamic.
Figure 2:
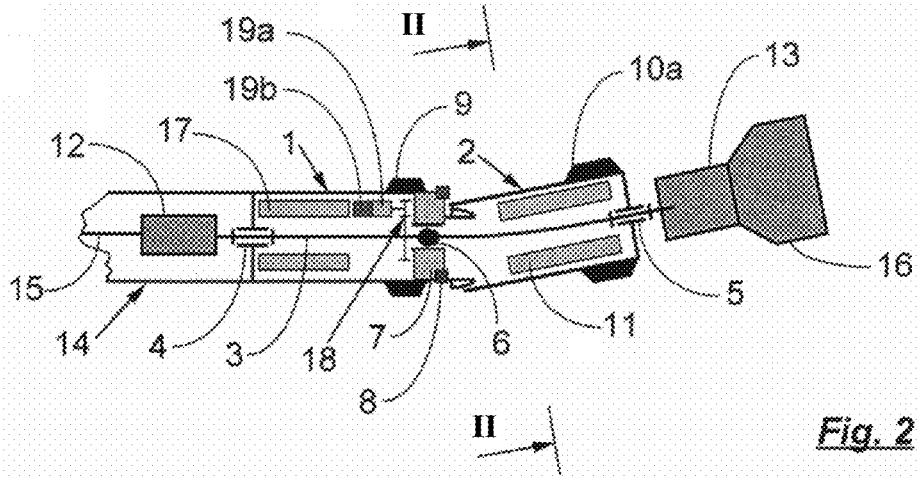
FIG. 2 represents in partial longitudinal schematic section a device according to FIG. 1 in a curved drilling position.
Figure 1A:
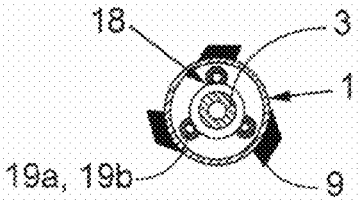
FIGS. 1A, 3A, 5A, 1B, 2B, 3B, 4B, 5B and 6B are schematic views in cross section along I-I or II-II, respectively, of the devices in the respective figures bearing the same numbers.
Figure 1B:
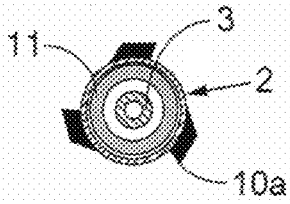
Figure 2B:
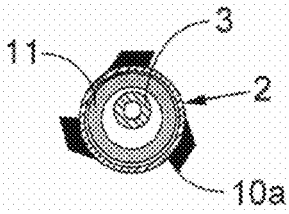
Figure 3:
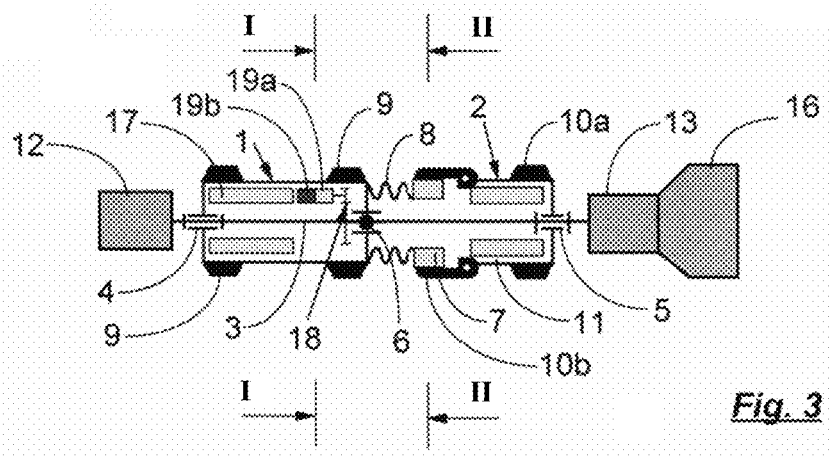
FIG. 3 represents in partial longitudinal schematic section a device according to the invention in its straight drilling position and in its embodiment described as dynamic with so-called "external" coupling.
Figure 4:
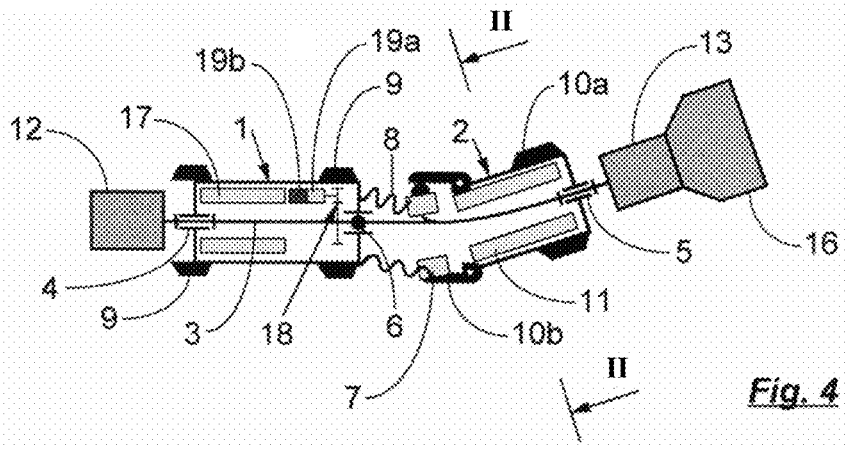
FIG. 4 represents in partial longitudinal schematic section a device according to FIG. 3 in a curved drilling position.
Figure 3A:
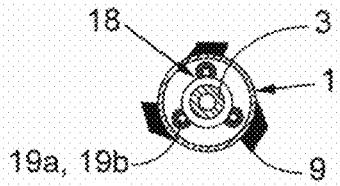
Figure 3B:
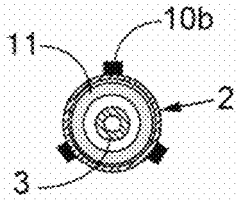
Figure 4B:
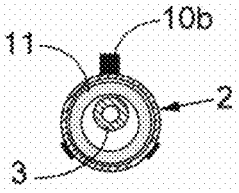
Figure 5:
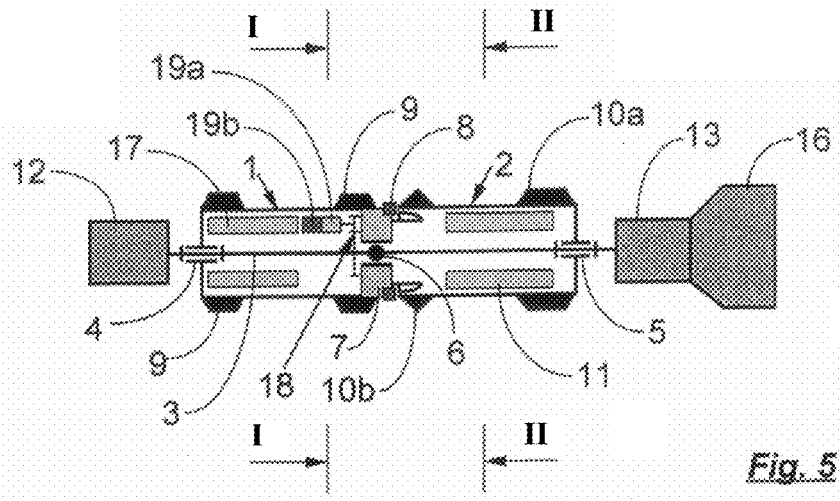
FIG. 5 represents in partial longitudinal schematic section a device according to the invention in its straight drilling position and in its embodiment described as dynamic, with so-called "internal" coupling.
Figure 6:
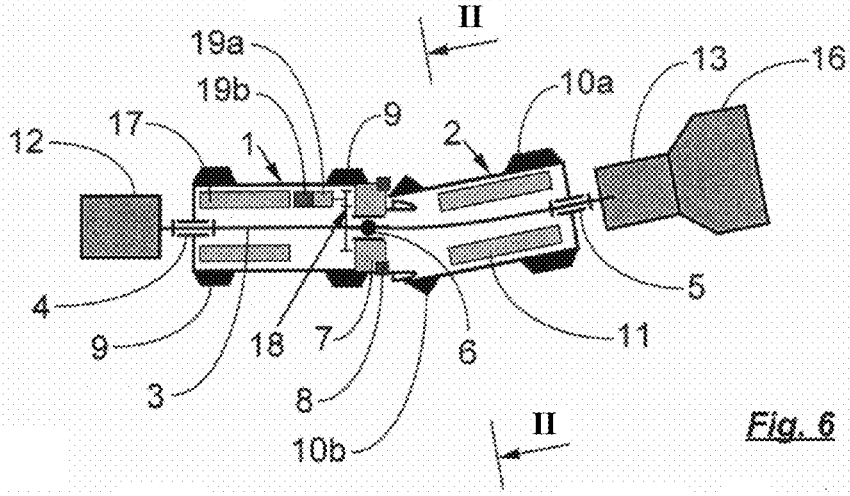
FIG. 6 represents in partial longitudinal schematic section a device according to FIG. 5 in a curved drilling position.
Figure 5A:
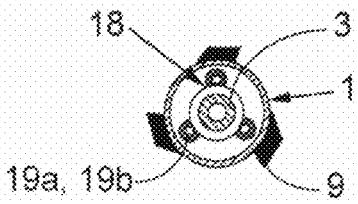
Figure 5B:
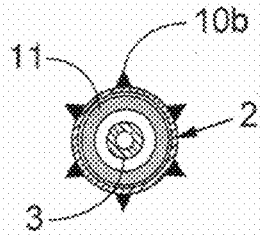
Figure 6B:
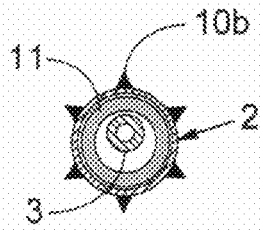

With reference to the drawings thus briefly described, notably FIGS. 1-8, which illustrate but in no way limit it, the device having a steerable connection architecture according to the invention essentially contains a main body 1 and a steerable housing 2, joined respectively by at least one connection of pivot, sliding pivot, ball joint or annular linear type forming a first bearing 4, and at least one pivot connection for a second bearing 5, to a bendable or flexible transmission shaft 3 which crosses them longitudinally, while an appropriate connection forming a third bearing 6 between said transmission shaft and the main body is arranged in proximity to the interface between said main body and said housing, and while steering is carried out thanks to means acting as a deflection system 7 in order to control the essentially radial displacement of the main body 1 in relation to the steerable housing 2 in proximity to their interface, the said main body being optionally equipped on its periphery with bearings pads 9 of diameter less than or equal to the diameter of the drilling tool/bit 16, and the said steerable housing being optionally equipped on its periphery with bearing pads 10*a* toward its end situated in the direction of the drilling tool/bit 16, and with fixed or expandable pads or clamps 10*b* toward its end situated in the direction of the main body 1, in order to bear on the wall of the well drilled (for an optimal deviation of the drilling tool/bit 16), and in order to permit the slowing down and even blocking on rotation of the main body 1 and steerable housing 2, respectively, by friction and by grooving of the wall of the well to be drilled.

"Appropriate connection forming a third bearing" is advantageously understood here to mean a connection of pivot, sliding pivot, annular linear or ball joint type.

In such a device, the steerable housing 2 is situated downstream from the main body 1 in relation to the direction of motion of the system integrating the device.

With such a device, the bending of the shaft 3, that is, steering at the desired angle between the longitudinal axes of the main body and steerable housing, is carried out by essentially radial displacement of the steerable housing 2 in relation to the main body 1 and/or in relation to the traversing transmission shaft 3 under the action of a deflection system 7.

In other words, a link is made between the main body 1 and the steerable case 2 in the form of a bendable or flexible shaft 3 joined to each of those two parts 1, 2 by a pivot connection and steering means placed between the main body 1 and the steerable housing 2 and capable of displacing the adjacent ends of the latter essentially radially in relation to one another.

In a static or pseudodynamic version, such a device also contains in practice a front scraper joint+gasket assembly 8, pads 9 for the main body 1, bearing pads 10*a* for the steerable housing 2, a pressurization device 11, a high connection 12 and a low connection 13, a functional assembly comprising stator-motor, turbine, etc. 14, a rotor-motor assembly, turbine, etc. 15 and a drilling tool/bit (PDC or tricone bit) 16, as well as by option one or more electronic compartments 17 containing sensors, a real time calculator, a gear, for example of pinion-step-up type 18 driving at least one alternator 19*a* and/or at least one hydraulic pump 19*b*.

In a purely illustrative embodiment, the pivot connection between the main body 1 and the shaft 3 is made by means (A) of a so-called upper bearing 4 of pivot or ball joint type and (B) of a so-called center bearing 6 of annular linear type, those two bearings being situated in proximity to both the respective ends of the main body 1, while the center bearing 6 is in the direction of the steerable housing 2, and the pivot connection between the steerable housing 2 and the shaft 3 is made by means of a so-called lower bearing 5, situated in proximity to the end of the steerable housing 2 located in the direction of the drilling tool/bit.

In practice, it is advantageous, on the one hand, to maximize the distance between the lower bearing 5 and the center bearing 6 on condition of preserving the compactness and the BUR and, on the other, of minimizing the distance between the lower bearing 5 and the drilling tool/bit 16, in order to maximize the lever arm between the median plane of the bearing pads 10*a*/plane of essentially radial displacement and the median plane of the bearing pads 10*a*/cutting front of said drilling tool/bit 16.

The device according to the invention makes it possible, in practice, to ensure a bent or tilt angle, called bent angle of approximately 0° to 1° and more.

In a preferred embodiment, the device according to the invention contains a main body 1 equipped with bearing pads 9 with the diameter of the drilling tool at each of its ends, and a steerable housing 2 equipped with bearing pads 10*a* with the diameter of the drilling tool at its lower end ("bit" side) and, in dynamic configuration, with clamps or blades at its upper end (main body side) to permit braking or even stop by blocking rotation of the main body 1 and steerable housing 2 by friction and grooving, respectively, of the wall of the well drilled.

In a variant, in the dynamic configuration, the main body can incorporate a stub end, advantageously made of tungsten, to limit rotation of the main body 1 and of the steerable housing 2 in relation to the wall of the well.

The system thus contains three bearings (4, 5, 6), on which at least one traversing shaft 3 is mounted, while deflection leads to the desired steering or tilt angle between the longitudinal axes of the main body and the steerable case.

Said deflection is carried out, in practice, by essentially radial displacement of the upper end of the steerable housing 2 in relation to the main body 1 by means of a deflection system 7.

An illustrative and nonrestrictive example of such a deflection system is a system advantageously containing a prestressed spring, a ball joint and two radially eccentric rings, such a system being controlled and lockable manually.

The deflection system is advantageously placed in front of the center bearing so that the point of rotation of the drilling tool is as close as possible to the center of the bearing pads 10*a* forming an annular linear connection with the wall of the well drilled, with the effect of reducing parasite stresses.

As for the front joint, it is preferably flattened against the end of the steerable housing 2 under the combined action of the internal overpressure of pressurization and of a spring, advantageously an undulated spiral spring.

The pressurization device is preferably placed in the steerable housing 2, but any other arrangement can be envisaged.

By way of illustration, the said bearings (4, 5, 6) can consist of roller bearings, notably ball bearings, spherical roller bearings, tapered roller bearings, cylindrical roller bearings or needle bearings or roller bearings called CARB™ marketed by the Swedish company SKF, as well as of hydrodynamic bearings, notably oil or drilling mud bearings, or of any combination of the two preceding types.

According to an advantageous embodiment of the invention, the bearings 4, 5, 6 are hydrodynamic or consist of ball bearings and/or roller bearings advantageously prestressed to maximize the stiffness of the bearings and their shock resistance.

In a preferred embodiment, the transmission shaft 3 is hollow-tubed to permit passage of the drilling fluid or fluids with minimum pressure drops, as well as passage of measurement probes descended by means of a cable during drilling (for measurements usually described as "thru the bit measurement").

According to another characteristic of the invention, it is advantageous for the transmission shaft 3 to be made of composite or alloy materials having a high ratio between its fatigue limit under reversed bending stress and its Young's modulus, in order to increase its flexibility in maximizing deviation or BUR without reducing its rotary bending lifetime, just like that of the lower bearing 5. The monobloc shaft is in this case advantageously made of titanium alloy, beryllium copper, non-magnetic stainless steel or a steel alloy having high mechanical characteristics. In the case of use with an MWD, which is then generally situated just above the device or even integrated with the latter, the non-magnetic alloys are preferred.

According to an alternative characteristic of the object of the invention, components such as bearings, roller bearings, annular gear, etc., are fastened on the shaft by thermal or mechanical hooping, so that the shaft contains no groove nor shoulder nor recess or, in practice, no rough or major changes of section. Only the ends of the shaft, which are less stressed, can present threading and joint grooves.

In one embodiment, the respectively low and high connections 12, 13 are joined with the transmission shaft 3 by threading combined with a mechanical hoop ensuring the transmission of tensile and compressive stresses respectively (abbreviated as WOB) and of the torque on the drilling tool/bit 16 (see FIG. 9).

In a preferred embodiment, these mechanical hoops come with hydraulic control to facilitate mounting and maintenance of the device assembly. Such a device thus avoids the use of an expensive tightening base or make-up/break-out unit, generally unavailable on the work site, and further makes possible the control of preloading of the roller bearings by simple measurement of hydraulic pressure, when the lower and upper bearings adjoin the connections (see FIG. 9).

More preferably, linkages are made between the said shaft and the high and low connections 12, 13 by threading for the axial stresses and by hooping for the transmission of torque. By tightening of the said hydraulically controlled hoop, the bearing linked to it can be prestressed.

Thus, according to the embodiment illustrated in FIG. 9 by way of nonrestrictive example, a shaft 3 centrally crosses the steerable housing 2 along its axis of axial symmetry Z-Z', and a bearing jacket 20 supports a bearing 5 equipped with an internal brace 21 and an external brace 22, as well as a bearing hoop 23. Placed between said bearing and the connection 24 (manually tightened on the shaft) on the drilling tool/bit 16 or, as a variant, the drilling tool/bit 16 itself are a tightness support 25, a connection hoop 26, a tapered ring 32 and a lock nut 29. An hydraulic plug/connection 27 and a tapered ring 32 for prestressing of the said bearing 5 and a lock nut 29 make possible pumping at a given pressure for placement/prestressing of the roller bearings and reversible mechanical hooping of the bearing jacket 20 on the shaft 3. The tightness support 25 is then tightened and pumping is carried out through the tightening orifice 28 in order to displace the hoop 26 axially in relation to the tapered ring 32 and thus ensure reversible mechanical hooping of the connection 24 on the shaft 3. The lock nut 29 is then tightened. Tightening is completed by an operation of tightening/locking of the tightness support 25 and lock nut 29 as well as of the hydraulic plugs/connections 27, 28 and 30.

The disassembly of such an assembly securing the mounting of bearings in a device according to the invention comprises the steps of: unlocking/loosening of the lock nut 29, pumping through the hydraulic connection 27, loosening of the tightness support 25, pumping through the hydraulic connection 30 for loosening of the bearing hoop 23 and manual loosening of the connection 24.

According to another characteristic of this object of the invention, all or almost all the structural components of the device essentially constituting the mass of the steerable connection are preferably non-magnetic alloys, ceramic, composite material and/or plastic, in order not to disturb the measurements of the MWD tools, which are generally situated just above the device of even integrated with it.

In an embodiment of the device according to the invention, the set of mechanisms bathe in oil maintained at an overpressure of approximately 0.01 to 1 MPa and more in relation to its environment, advantageously thanks to a pressurization device preferably made by means of an annular piston under the pressure exerted by the surrounding fluid and a spring housed between the body of the case and the transmission shaft. In a preferred embodiment, a front scraper joint and gasket assembly or a metal, plastic or laminated elastomer bellow ensures tightness between the main body 1 and the steerable housing 2.

As for as the elements intended to constitute the supports of the main body 1 and steerable housing 2 on the walls of the borehole, they are advantageously straight or spiral blades, preferably stripped in order to reduce the risk of clogging, serving as non-rotary stabilizers of diameter less than or equal to the diameter of the drilling tool/bit. These non-rotary stabilizers are preferably fitted with respectively aligned or spiral "buttons," advantageously of tungsten carbide or polycrystalline diamond (abbreviated PDC) or provided with an abrasion-resistant deposit.

When it is designed to constitute a dynamic connection with internal coupling, the device according to the invention is advantageously equipped, at the end of the steerable housing 2 situated in the direction of the deflection system 7, with longitudinal blades or clamps 10*b* intended to make possible braking in rotation of the steerable connection by grooving of the wall of the well drilled. In practice, those clamps or blades are advantageously made of tungsten carbide or of polycrystalline diamond (abbreviated PDC) in order to optimize their longevity regardless of the type of formation drilled.

As for the deflection device integrated in the connection device according to the invention, it is preferably made, in the case of a static connection device, by means of two radially eccentric rings, a ball joint and a sliding pivot link controlled by a spring; deflection is then obtained by differential rotation of the two rings.

For a pseudodynamic or dynamic device, this deflection device is made according to standard on the basis of the expert's knowledge.

According to one advantageous characteristic, for the forms of use of the invention necessitating hydraulic power, the jack or jacks are preferably fed by a pump whose pistons are in a barrel arrangement around the shaft and driven by a cam integrated with said shaft. As a variant, one or more barrel pumps 19*b* can be provided or used, driven by a pinion-step-up gear assembly.

The power supply of each jack is advantageously driven by a normally open solenoid valve. If the steering system thus designed is reversible, the system spontaneously returns to its neutral position, in order to guarantee the return of the device according to the invention to a straight drilling position in case of trouble and thus limit the risks of wedging during the ascent of the drilling assembly.

According to another advantageous embodiment and, in particular, in an embodiment requiring electric power, the steering device according to the invention does not have any battery and is fed by an annular generator, notably with permanent magnets (not represented) arranged around the shaft 3 and driven by the latter by means of a planetary gear train, not represented. As a variant one or more generators can be provided and used in a barrel arrangement around the shaft 3 and driven by the latter by means of a pinion-step-up gear assembly. The said generators are then advantageously coupled to one or more rectifiers that can be coupled in series or in parallel for a wide speed range and a plurality of high-capacity capacitors in order to serve as battery during rotation-free operation of the shaft.

The said pump or pumps and the said generator or generators are arranged on the same axis and advantageously share the same driving pinion.

The device according to the invention advantageously contains a rearranged assembly of pumps, generators, solenoid valves, jacks and overpressure reliefs, set up to activate means of relative displacement.

According to another characteristic of the steering device of the invention, the main body 1 integrates sensors of "at bit" measurements like, for example, measurements of inclination, azimuth, pressure, temperature, natural gamma radiation, resistivity, "WOB," at bit torque, "bit bouncing" and/or "whirling," rotation speeds, "stick-slip" or chatter, etc.

By design, the natural gamma radiation measurements are directional, taking into account the eccentration of the said crystals and the rotation (slow) of the main body 1 in relation to the well drilled. In that regard, several crystals regularly distributed in a barrel arrangement around the shaft can be used in the known manner.

The rotation (slow) of the main body 1 in relation to the well drilled being random, the generator or generators can be short-circuited and/or the pump(s) can be stopped in order to control rotation of the main body 1 in relation to the well drilled by rotation of the rods.

According to one particular embodiment of the pseudodynamic version of the steering device of the invention, the main body 1 includes a detector of rotation (not represented) of the drill string (in the absence of rotation, it is in "sliding" mode with shaft 3 bent, while with rotation, it is in "rotary" mode with shaft straight, for an autonomous activation of the steerable housing 2, without resorting to a surface/bottom transmission.

According to a variant embodiment of the pseudodynamic version of the steering device of the invention, the detector of rotation of the drill string is entirely mechanical (for example, unbalanced weight in free rotation around the main body 1, weight in radial translation, etc.) for high-temperature applications, notably, at temperatures of approximately 200° C. and more.

In the embodiment of the steering device according to the invention providing the latter with a dynamic function, said device advantageously integrates in or on its main body 1 inclination and azimuth sensors or a center of inertia or an unbalanced weight in free rotation associated with an angular coder and an inclinometer, coupled to a real time calculator, in order to drive the deflection device in a given direction or trajectory.

According to another characteristic of the invention, in its pseudodynamic as well as dynamic embodiment, the steering device can be remote-controlled from the surface by means of a coding using mud pressure and/or rotation of the drill string as parameters, or even by means of electromagnetic wave transmission with or without relays.

An appropriate bidirectional communication equipping the steerable connections according to the invention, of pseudodynamic as well as of dynamic type, has the advantage of making it possible to transmit on the surface measurements made at the tool level (so-called to bit measurements) with or without relays, according to preferences and environmental constraints, which makes drilling interactive.

Furthermore, it is advantageous to equip the steering device according to the invention with sensors, such as those indicated above, and with an electric interface with connector (containing at least one wire+ground), advantageously with four contacts (2 powering wires and 2 communication wires) plus ground, to make dialogue (programming, parametering, memory rereading, etc.) possible with a computer or even directly by network.

The expert will, of course, understand that the steering device according to the invention is included, In practice, among the standard upstream elements (MWD, LWD, motor, etc., and boring rods) and the downhill drilling tool (bit[/PDC/drill), or can ultimately integrate or be integrated with one of those elements.

The invention also concerns a method for making controlled boreholes, that is, necessitating precise trajectory control. In such a method according to the invention, at least one steering/resteering device according to the present invention is supplied and put into operation under the action of an appropriate deflection device.

Application of the resteering device can prove particularly advantageous when the borehole has undergone an undesired curvature or when it is preferable to resteer the trajectory of a well whose production is dropping.

In a preferred embodiment, the method according to the invention has the advantageous characteristics, embodiments and/or variants indicated above for the steerable connection device itself or its components.

The invention thus provides an architecture for the steering of a drilling tool, making it possible to overcome limitations of the prior art and having as striking advantages a reduced length, the possibility of providing a high BUR in spite of a narrow tilt angle, great reliability and extremely easy manufacture and maintenance.

Unidirectional surface-bottom transmission can optionally be incorporated in the device of the invention, operating, for example, by pressure variation or, for example, by rotation of the drill string and coding/decoding on generators, and thus make driving the system possible from the surface, by resorting to the expert's knowledge. Surface-bottom or local one-way or two-way electromagnetic transmission can be incorporated in this device, also making possible the interactive drive of the system in real time.

Said method can optionally include analysis of the variations of signals from the said generator or generators, with a view to detecting a malfunction such as excess speed or chatter ("stick-slip").

It can also include the use of methods for the advantageously mechanical detection of modes of drilling by progression without rotation of the drill string ("sliding") and with rotation of the drill string ("rotary") for autonomous operation.

As a variant, the method can involve the use of means of steering of the steerable housing 2, notably, by inclusion advantageously in the main body 1 of an unbalanced weight coupled to an angular coder and an inclinometer, as well as of a real time calculator.

The method according to the invention can also involve the use of means of driving the steerable housing 2 in all directions, notably by inclusion advantageously in the main body of a deviation probe (consisting preferably of 3 magnetometers+3 accelerometers) and a real time calculator. As a variant, that functionality can be ensured by inclusion in the main body 1 of a center of inertia, advantageously of MEMS type, and of a real time calculator.

For measurement of the torque at the drilling tool/bit 16, which is of practical value, methods known to the expert can be used. With the device according to the invention, one can advantageously proceed by measurement of the torsional angle of the shaft 3 between the bearings 4 and 6. For that purpose, use is recommended of instrumented roller bearings serving as coder, of the generator or generators 19*a* or magnets associated with at least one Hall effect sensor or of a combination of those elements, and proceeding with these means to a direct measurement of phase shift between the two measurements, as well as to a measurement of speed by generators.

Beside its capacity to reduce the overall cost per meter of hole drilled, the device according to the present invention possesses a miniaturization potential making it possible to envisage drilling phases of less than or equal to $5^{7/8}$". It is compatible, moreover, with a "reamer/underreamer" (in English), placed upstream from said device. Different diameters can thus be drilled with one and the same device.

In all cases, the drilling fluid or fluids and the WOB ("weight on bit") pass directly through the tubular transmission shaft, making it possible, respectively, to reduce pressure drops and, in the case of static and pseudodynamic systems, to place the thrust bearing in the main body 1. The length of the steerable case 2 is thus reduced to the limit, without that compromising the lifetime of the thrust bearing, whence a high BUR with a narrow tilt/bent angle.

In the case of a pseudodynamic connection, the abovementioned advantages are further supplemented by the possibilities, notably:

of activating steering of the case automatically or from the surface, following the straight shaft "rotary" drilling mode for straight boreholes and bent shaft "sliding" mode for boreholes necessitating precise control of trajectory; the rotation of the bent case in "rotary" mode is thus avoided, and the quality of the hole drilled is similar to what would be obtained with an RSS, but with a simpler system and, therefore, more reliable and less expensive system;

of instrumenting the motor with pressure, temperature, deviation, natural gamma radiation, neutron sensors, etc., placed in the main body, which makes to bit measurements possible; and of installing bottom/surface communication in order to have to bit measurements in real time on the surface.

In the case of a dynamic connection, it is thus possible:

to reduce the length of the RSS considerably, in order to improve the quality of the measurements during drilling (MWD/LW) by reducing the distance between the different points of measurement and the bit (PDC or tricone bit, for example);

to increase the BUR and render RSS directional performances insensitive to the inclination of said RSS with support of the main body and case to the diameter of the drilling tool/bit; and to reduce the weight, investment and costs of use of the product and transportation, among other things;

to give access to all the mechanical and electronic parts of the RSS without the need to completely disassemble said RSS, so that the costs of assembly and maintenance will be markedly reduced;

to reduce by more than 30% the stresses in all the mechanisms and connections of the different parts constituting the RSS, as well as the number of mechanical components, and thereby increase the reliability of said RSS;

to miniaturize the RSS for boreholes of less than or equal to $5^{7/8}$";

to facilitate the introduction of RSS devices existing on the market by taking advantage of the experience already acquired with bent housing of downhole motors, which have equipped the latter since 1962; and to attain a potential rotation speed higher than in the case of most of the existing systems.

It is to be further noted that the abovementioned advantages should lead to a very significant reduction of the overall cost per meter drilled—which cannot be attained with the drilling devices currently known—while affording greater opportunities for use of downhole motors as well as of the RSS.

The invention claimed is:

1. A drilling tool steering device comprising consecutively from upstream to downstream, a main body (1) and a steerable housing (2); a deflection system (7); and a flexible transmission shaft (3) which crosses the main body, the steerable housing, and the deflection system longitudinally, said transmission shaft being substantially fixed in the longitudinal direction with respect to the main body and the steerable housing while being moveable in the radial direction, and being connected to the main body (1) and to the steerable housing (2) by at least three connections forming bearings (4, 5, 6), wherein the connection between the main body (1) and the shaft (3) is made by an upper bearing (4) of pivot, sliding pivot, ball joint or annular linear type, and a center bearing (6) of pivot, sliding pivot, annular or ball joint type, those two bearings being situated in proximity to both the respective ends of the main body (1), wherein the center bearing (6) is in the direction of the steerable housing (2), wherein the connection between the steerable housing (2) and the flexible transmission shaft (3) is made by a lower bearing (5) of pivot type, situated in proximity to the end of the steerable housing (2) locating in the direction of the drilling tool (16), and wherein the deflection system (7) is configured to bend said transmission shaft by radially displacing the upper end of the steerable housing (2) in relation to the lower end of the main body (1).

2. The device according to claim 1, wherein the deflection system (7) is designed to make said radial displacement possible by bearing on the transmission shaft (3), the main body (1), or on the wall of a well drilled.

3. The device according to claim 1, wherein a link is made between the main body (1) and the steerable housing (2) in the form of a bendable or flexible shaft (3) connected to each of the main body (1) and the steerable housing (2) by a pivot connection and displacement means placed between the main body and the steerable housing and capable of displacing the adjacent ends of the main body and of the steerable housing essentially radially in relation to one another.

4. The device according to claim 1, wherein said bearings (4, 6) consist of roller bearings selected from the group consisting of, ball bearings, tapered roller bearings, cylindrical roller bearings or needle bearings, advantageously prestressed, or of hydrodynamic bearings, notably oil or drilling mud bearings, or of any combination of same.

5. The device according to claim 1, wherein the device is designed to constitute a dynamic connection and is equipped, at the end of the steerable housing (2) situated in the direction of the deflection system (7), with clamps or blades intended to permit, on deflection of the shaft (3), locking or braking of the device on rotation by grooving of the wall of the borehole.

6. The device according to claim 1, wherein the shaft (3) is a monobloc tubular transmission shaft made of composite materials or alloys having a high ratio between the fatigue limit under reversed bending stress and the Young's modulus, and said shaft does not contain sudden section changes, while just the ends of the shaft can optionally be threaded and can present joint grooves, and while the components such as roller bearings, annular gear and others are fitted on the shaft by thermal or mechanical hooping.

7. The device according to claim 1, wherein respectively low and high connections are joined with the shaft (3) by threading combined with a hydraulically controlled hoop, ensuring the transmission of tensile and compressive axial stresses and torque to the drilling tool, respectively.

8. The device according to claim 1, further comprising a front scraper joint and gasket assembly or a metal, plastic or laminated elastomer bellow that ensures tightness at the interface between the main body (1) and the steerable housing (2).

9. The device according to claim 1, wherein the deflection system (7) is formed, in the case of a static connection device, by two radially eccentric rings, a ball joint and a sliding pivot connection, as well as by a prestressed spring, deflection then being obtained by differential rotation of the two rings.

10. The device according to claim 1, wherein the main body (1) integrates a detector of rotation of boring rods that is advantageously entirely mechanical or rotating with the shaft for an autonomous activation of the steerable housing, without resorting to a surface/bottom transmission.

11. The device according to claim 1, further comprising one or more generators (19*a*) in a barrel arrangement around the shaft (3) and driven by the shaft by means of a pinion-step-up gear assembly (18), the said generators being preferably coupled to one or more rectifiers that can be coupled in series or in parallel for a wide speed range, and a plurality of high-capacity capacitors, in order to serve as a battery during rotation-free operation of the shaft (3).

12. The device according to claim 1, further comprising one or more hydraulic pumps (19*b*) in a barrel arrangement around the shaft (3) and driven by the shaft by means of a pinion-step-up gear assembly (18).

13. The device according to claim 11, characterized in that the device contains a rearranged assembly of pumps, generators, solenoid valves, jacks and overpressure valves, set up to activate the deflection system (7), said pumps and said generators being coaxial and sharing the same driving pinion.

14. The device according to claim 1, further comprising means for real time measurement of the torsional angle of the shaft (3) between the bearings (4) and (6), as measurement of the torque at the drilling tool/bit (16).

15. The method for making boreholes necessitating precise control of trajectory, comprising the steps of supplying at least one device according to claim 1 and putting the at least one device into operation to make a borehole.

16. The method according to claim 15, wherein the shaft (3) is bent by means of the deflection system (7) by essentially radial displacement of the steerable case (2) in relation to the main body (1) and/or in relation to the traversing transmission shaft (3).

17. The method according to claim 15, wherein the device further comprises one or more generators (19*a*) in a barrel arrangement around the shaft (3) and driven by the shaft by means of a pinion-step-up gear assembly (18), the said generators being preferably coupled to one or more rectifiers that can be coupled in series or in parallel for a wide speed range, and a plurality of high-capacity capacitors, in order to serve as battery during rotation-free operation of the shaft (3), further comprising the step of analyzing the variations of signals from the generator or generators, with a view to the detection of a malfunction, such as excess speed or chatter.

18. The device according to claim 12, characterized in that the device contains a rearranged assembly of pumps, generators, solenoid valves, jacks and overpressure valves, set up to activate the deflection system (7), said pumps and said generators being coaxial and sharing the same driving pinion.

19. The device according to claim 1, wherein the transmission shaft (3) is joined to the main body (1) and to the steerable housing (2) by:

- a first bearing (4) formed by at least one connection of pivot, sliding pivot, ball joint or annular linear type, and
- a second bearing (5) formed by at least one connection of pivot type, and
- a third bearing (6) is formed by a connection of pivot, sliding pivot, annular linear or ball joint type, between said transmission shaft (3) and the main body (1), arranged in proximity to an end of said main body situated in the direction of the steerable housing.

20. The device according to claim 19, wherein said main body (1) is equipped on its periphery with bearing pads (9) of diameter less than or equal to the diameter of the drilling tool/bit (16), and wherein said steerable housing is equipped with bearing pads (10*a*) of diameter less than or equal to the diameter of the drilling tool (16) toward its end situated in the direction of the drilling tool, and with fixed or expandable pads or clamps (10*b*) toward its end situated in the direction of the main body (1).

* * * * *